US005102857A

United States Patent [19]

Okada

[11] Patent Number: 5,102,857

[45] Date of Patent: Apr. 7, 1992

[54] HEAT-SENSITIVE RECORDING MATERIAL

[75] Inventor: Akinori Okada, Tokyo, Japan

[73] Assignee: Mitsubishi Paper Mills Limited, Tokyo, Japan

[21] Appl. No.: 637,443

[22] Filed: Jan. 4, 1991

[30] Foreign Application Priority Data

Jan. 19, 1990 [JP] Japan ..... 2-010273

[51] Int. Cl.[5] ..... B41M 5/30

[52] U.S. Cl. ..... 503/209; 503/208; 503/216; 503/225

[58] Field of Search ..... 503/208, 209, 225, 216; 427/150–152

[56] References Cited

U.S. PATENT DOCUMENTS

| | | | |
|---|---|---|---|
| 4,764,500 | 8/1988 | Araki et al. | 503/209 |
| 4,956,333 | 9/1990 | Kawahara et al. | 503/209 |
| 4,999,332 | 3/1991 | Okumura et al. | 503/209 |

*Primary Examiner*—Pamela R. Schwartz
*Attorney, Agent, or Firm*—Cushman, Darby & Cushman

[57] ABSTRACT

A heat-sensitive recording material which comprises a support and a heat-sensitive recording layer provided on the support, the heat-sensitive recording layer comprising a colorless or pale-colored dye precursor, a developer which reacts with the dye precursor to form color upon heating, and two compounds represented by the following formulas (I) and (II):

(I)

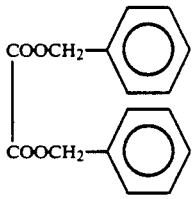

(II)

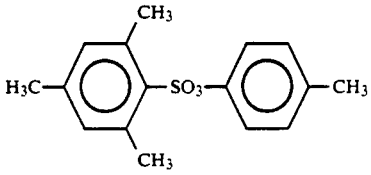

The heat-sensitive recording material causes little fogging and generates little thermal head scum while having almost the same sensitivity and image stability as conventional heat-sensitive recording materials.

2 Claims, No Drawings

HEAT-SENSITIVE RECORDING MATERIAL

BACKGROUND OF THE INVENTION

The present invention relates to a heat-sensitive recording material, and more particularly to a heat-sensitive recording material which is excellent in sensitivity and image stability, generates little scum adhering to a thermal head (hereinafter referred to as "thermal head scum"), and causes little fogging due to heat built up in a thermal head (hereinafter referred to as "fogging").

Generally, heat-sensitive recording materials comprise a support having provided thereon a heat-sensitive recording layer comprising, as essential components, an electron-donating dye precursor which is generally colorless or pale-colored, and an electron-accepting developer. Upon heating the heat-sensitive recording material by a thermal head, a thermal pen, a laser beam, or the like, the dye precursor and the developer instantly react with each other to form color. Thus, recorded images are obtained thereon. Such heat-sensitive recording materials are disclosed in Japanese Pat. Appln. Kokoku (Post-Exam.) Nos. S. 43-4160 and S. 45-14039 and the like.

Such heat-sensitive recording materials have advantages, for example, that records can be obtained by a relatively simple apparatus. Thus, heat-sensitive recording materials are used in a wide variety of fields such as measuring recorders, facsimile machines, printers, terminals of computers, labels, ticket vending machines, and the like.

Heat-sensitive recording materials require to have, for example, the following principal characteristics: The recording materials have sufficient sensitivity. Images to be formed thereon have sufficient optical density and do not substantially cause discoloration with the lapse of time.

Recently, attempts have been made for the purpose of speed-up of recording. Therefore, there has been desired development of a heat-sensitive recording material which has high sensitivity so as to give recorded images having sufficient density even when printing is carried out with low energy in order to adapt such attempts.

Furthermore, as heat-sensitive recording materials have been used so widely, images to be formed thereon are required to cause little discoloration even when fatty materials such as fats and oils contained in hair treatment agents, hand creams, sweat, etc. adhere to the recording materials.

As described above, heat-sensitive recording materials have been required to have higher sensitivity and image stability.

In order to obtain recorded images having high density, various sensitizers are contained in a recording layer of recording materials. As sensitizers, for example, Japanese Pat. Appln. Kokoku No. S. 43-4160 discloses urea, phthalic anhydride, acetanilide, and the like. Japanese Pat. Appln. Kokoku No. S. 48-19231 discloses natural and synthesized waxes such as beeswax, carnauba wax, paraffin wax, Japanese Pat. Appln. Kokoku No. S. 49-17748 discloses salicylic acid, monobenzyl ester of phthalic acid, and the like.

Although sensitivity is improved by use of these sensitizers, other characteristics are often deteriorated. For example, a considerable amount of thermal head scum is generated and serious fogging is caused.

In order to improve image stability, developers of bisphenol sulfone type are proposed. Specifically, Japanese Pat. Appln. Kokai (Laid-Open) Nos. S. 60-208286 and S. 60-13852 disclose bis(3-allyl-4-hydroxyphenyl)-sulfone and 4-hdyroxy-4'-isopropyloxy-diphenylsulfone as this type developers, respectively.

At present, 2,2-bis(4-hydroxyphenyl)propane (hereinafter referred to as "BPA") is widely used as a developer. Compared with recording materials comprising BPA, those comprising the bisphenol sulfone type developer have much improved image stability but are not sufficient in sensitivity.

SUMMARY OF THE INVENTION

It is an object of the present invention to provide a heat-sensitive recording material which is excellent in sensitivity and image stability, generates little thermal head scum and causes little fogging.

The present inventors have conducted extensive research in order to attain the above object. As a result, it has been found that the object can be attained by containing specific two compounds as sensitizers in a heat-sensitive recording layer of a recording material.

According to the present invention, there is provided a heat-sensitive recording material which comprises a support and a heat-sensitive recording layer provided on the support, the heat-sensitive recording layer comprising a colorless or pale-colored dye precursor, a developer which reacts with the dye precursor to form color upon heating, and two compounds represented by the following structural formulas (I) and (II)

(I)

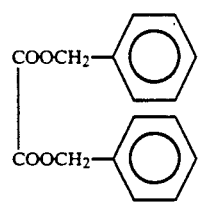

(II)

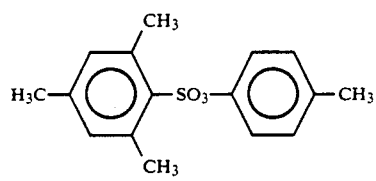

DETAILED DESCRIPTION OF THE INVENTION

The present invention is explained in detail below.

The heat-sensitive recording material of the present invention comprises a support and a heat-sensitive recording layer provided on the support.

The heat-sensitive recording layer comprises a dye precursor, a developer, and two compounds represented by the formulas (I) and (II) (these compounds are hereinafter referred to as "Compound I" and "Compound II", respectively). In addition to these components, the heat-sensitive recording layer may optionally contain a binder, pigment, and the like.

Heat-sensitive recording materials comprising Compound I without Compound II are superior in sensitivity to those comprising other conventional sensitizers. However, such recording materials generate thermal head scum and cause fogging so that the recording materials cannot be used practically.

Moreover, heat-sensitive recording materials comprising Compound II without Compound I generate little thermal head scum but are poor in sensitivity and cause fogging.

In the present invention, it has been found that thermal head scum and fogging can be prevented from being caused without deteriorating sensitivity by use of Compounds I and II in combination. Based on this finding, the present invention has been accomplished.

The developer used in the present invention includes 4-phenylphenol, 4-hydroxyacetophenone, 2,2'-dihydroxydiphenyl, 2,2'-methylenebis(4-chlorophenol), 2,2'-methylenebis(4-methyl-6-tert-butylphenol), 2,2'-bis(4-hydroxyphenyl)propane (bisphenol A), 4,4'-isopropylidenebis(2-chlorophenol), 4,4'-isopropylidenebis(2-methylphenol), 4,4'-ethylenebis(2-methylphenol), 4,4'-thiobis(6-tert-butyl-3-methylphenol), 1,1'-bis(4-hydroxyphenyl)cyclohexane, 2,2'-bis(4-hydroxyphenyl)-n-heptane, 4,4'-cyclohexylidenebis(2-isopropylphenol), salicylic acid anilide, novolak type phenol resins, benzyl p-hydroxybenzoate, and the like. However, preferred is a compound represented by the following structural formula (III) in view of image preservability:

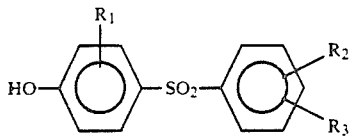

(III)

wherein $R_1$ and $R_2$ are independently hydrogen atoms, alkenyl groups, alkyl groups, halogen atoms or hydroxy groups, $R_3$ is hydrogen atom, hydroxy group, alkoxy group or alkyl group.

Specifically, the compound represented by the formula (III) (hereinafter referred to as "Compound III") includes bis(3-allyl-4-hydroxyphenyl)sulfone, 3,3'-dimethyl-4,4'-dihydroxyphenylsulfone, 4-hydroxy-4'-propyloxydiphenylsulfone, 4-hydroxy-4'-methyldiphenylsulfone, 3,4-dihydroxy-4'-methyldiphenylsulfone, 3-chloro-4-hydroxy-4'-methyldiphenylsulfone, 4,4'-dihydroxysulfone, and the like.

Also in case that Compound III is used as the developer, sufficient effects cannot be obtained unless Compounds I and II are used in combination.

That is, heat-sensitive recording materials comprising Compounds I and III without Compound II are superior in sensitivity and image stability to those comprising conventional sensitizers other than Compounds II and III, but generate thermal head scum and cause fogging, and hence cannot be used practically. Heat-sensitive recording materials comprising Compounds II and III without Compound I are sufficient in image stability and generate little thermal head scum but are poor in sensitivity and cause fogging. However, heat-sensitive recording materials comprising Compounds I, II and III generate little thermal head scum and cause little fogging while maintaining high sensitivity and image stability which come from the use of Compound I.

The above-mentioned effects cannot be obtained by any other combinations of conventional sensitizers and are not foreseeable from any conventional arts.

Moreover, it has been found that the above-mentioned effects depend upon the contents of these compounds. Specifically, it is preferable that Compounds I and II be contained respectively in amounts of 25–75% and 50–100% by weight based on the weight of the developer and totally in an amount of 75–175% by weight based on the weight of the developer. It is more preferable that Compounds I and II be contained respectively in amounts of 35–65% and 60–90% by weight based on the weight of the developer and totally in an amount of 95–155% by weight based on the weight of the developer.

When the content of Compound I is less than 25% by weight, sufficient sensitivity cannot be obtained. When the content of Compound I is more than 75% by weight, thermal head scum and fogging become considerably observed. When the content of Compound II is less than 50% by weight, thermal head scum becomes considerably observed. When the content of Compound II is more than 100% by weight, it becomes difficult to obtain a sufficient sensitivity.

Explanation is made below on other components used in the present invention. However, the present invention is not restricted by the following explanation.

The dye precursor used in the present invention includes compounds of triphenylmethane type, fluoran type, diphenylmethane type, thiazine type, spyropyran type, and the like. Specifically, there may be mentioned 3,3-bis(p-dimethylaminophenyl)-6-dimethylaminophthalide (Crystal Violet Lactone), 3-diethylamino-7-methylfluoran, 3-diethylamino-6-chloro-7-methylfluoran, 3-diethylamino-6-methyl-7-chlorofluorane, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-cyclohexylamino)-3-methyl-7-anilinofluoran, 3-piperidino-3-methyl-7-anilinofluoran, 3-dibutylamino-6-methyl 7-anilinofluoran, 3-(N-methyl-N-propyl)amino-6-methyl-7 anilinofluoran, 3-(N-methyl-N-isopropyl)amino-6-methyl-7-anilinofluoran, 3-(N-ethyl-N-tetrahydrofurfuryl)amino-6-methyl-7-anilinofluoran, and the like.

The binder used in the present invention includes water-soluble binders such as starches, hydroxyethylcellulose, methylcellulose, carboxymethylcellulose, gelatin, casein, polyvinyl alcohol, modified polyvinyl alcohol, styrene/maleic anhydride copolymer, and ethylene/maleic anhydride copolymer; latex type water-insoluble binders composed of styrene/butadiene copolymer, acrylonitrile/butadiene copolymer, methyl acrylate/butadiene copolymer, etc.; and the like.

The pigment used in the present invention includes diatomaceous earth, talc, kaolin, calcined kaolin, calcium carbonate, magnesium carbonate, titanium oxide, zinc oxide, silicon oxide, aluminium hydroxide, urea-formaldehyde resin, and the like.

In addition to the above components, the heat-sensitive layer may contain the following compounds for the purpose of prevention of head abrasion, sticking, and the like: a metal salt of higher fatty acid such as zinc stearate or calcium stearate; a wax such as paraffin, oxidized paraffin, polyethylene, oxidized polyethylene, stearamide or castor-wax; a dispersant such as sodium dioctylsulfosuccinate; an ultraviolet-ray absorbent of benzophenone type, benzotriazole type or the like; a surfactant; a fluorescent dye; and the like.

As the support, paper is mainly used in the present invention. However, a nonwoven fabric, a plastic film, a synthetic paper, a metal foil or a composite sheet consisting of a combination of them can also be used.

DESCRIPTION OF PREFERRED EMBODIMENTS

(1) Preparation of Heat-Sensitive Recording Materials

Example 1

Thirty g of 3-dibutylamino-6-methyl-7-anilinofluoran was added to 70 g of water containing 1.5 g of polyvinyl alcohol and then ground in a paint conditioner to obtain Dispersion 1.

Forty g of bis(3-allyl-4-hydroxyphenyl)sulfone was added to 60 g of water containing 2 g of polyvinyl alcohol and then ground in a paint conditioner to obtain Dispersion 2.

Fifteen g of Compound I was added to 50 g of water containing 0.75 of polyvinyl alcohol and then ground to obtain Dispersion 3.

Thirty five g of Compound II was added to 117 g of water containing 1.75 g of polyvinyl alcohol and then ground to obtain Dispersion 4.

Thus obtained Dispersions 1–4 were mixed with one another. To the dispersion mixture were added 75 g of 40% aqueous dispersion of calcium carbonate, 25 g of 40% aqueous dispersion of zinc stearate, 160 g of 10% aqueous solution of polyvinyl alcohol, and 170 g of water. The resulting mixture was stirred sufficiently to obtain a coating composition.

Ten g of calcined kaolin was mixed with 20 g of 10% aqueous solution of polyvinyl alcohol and then sufficiently stirred. The resulting mixture was coated on a sheet of paper having a basis weight of 42 g/m$^2$ so as to obtain a coating weight of 5 g/m$^2$ in terms of dry content to prepare a support.

The thus prepared support was coated with the coating composition obtained above so as to obtain a coating weight of 4 g/m$^2$ in terms of dry content. Thus coated support was subjected to calendering treatment to prepare a heat-sensitive recording material.

Example 2

The same procedure as in Example 1 was repeated, except that 25 g of Compound I was used to obtain Dispersion 3 and 25 g of Compound II was used to obtain Dispersion 4.

Example 3

The same procedure as in Example 1 was repeated, except that 10 g of Compound I was used to obtain Dispersion 3 and 40 g of Compound II was used to obtain Dispersion 4.

Example 4

The same procedure as in Example 1 was repeated, except that 30 g of Compound I was used to obtain Dispersion 3 and 20 g of Compound II was used to obtain Dispersion 4.

Comparative Example 1

The same procedure as in Example 1 was repeated, except that 50 g of Compound I was used to obtain Dispersion 3 and Dispersion 4 was eliminated.

Comparative Example 2

The same procedure as in Example 1 was repeated, except that 50 g of Compound II was used to obtain Dispersion 4 and Dispersion 3 was eliminated.

Comparative Example 3

The same procedure as in Example 1 was repeated, except that 5 g of Compound I was used to obtain Dispersion 3 and 45 g of Compound II was used to obtain Dispersion 4.

Comparative Example 4

The same procedure as in Example 1 was repeated, except that 40 g of Compound I was used to obtain Dispersion 3 and 10 g of Compound II was used to obtain Dispersion 4.

(2) Evaluation of Heat-Sensitive Recording Materials

On the recording materials obtained in Examples 1–4 and Comparative Examples 1–4, recording was carried out at a head voltage of 11 V and an applied period of 5 ms by a G3 facsimile tester (TH-PMD, manufactured by Okura Denki K. K.) equipped with a thermal head having a dot density of 8 dots/mm and head resistance of 185 Ω. The optical density of the image thus recorded was measured by a Macbeth RD-514 type reflection densitometer.

Moreover, the recording materials on which an image had been recorded above were stored at 60° C. for 24 hours in a constant temperature room. After the storage, the density of the recorded image was measured in the same manner as the above. And then image stability was calculated according to the following formula $$\text{Image stability (\%)} = \frac{\text{Density of image after the storage}}{\text{Density of image before the storage}} \times 100$$

On the other hand, the heat-sensitive recording materials on which an image had not been recorded were placed in contact with a block heated at 85° C. under a pressure of 200 g/cm$^2$ for 3 seconds. And then the density of the portion which had been in contact with the block was measured in the same manner as the above to evaluate the degree of fogging due to heat built up in a thermal head. The smaller the density, the less the degree of fogging.

The results obtained above are shown in the following table.

TABLE

| | Sensitivity | Image stability, % | Fogging | Thermal head scum |
|---|---|---|---|---|
| Example 1 | 1.05 | 95 | 0.25 | ○ |
| Example 2 | 1.00 | 94 | 0.30 | ○ |
| Example 3 | 0.80 | 94 | 0.40 | ○ |
| Example 4 | 0.85 | 92 | 0.43 | Δ |
| Comparative Example 1 | 1.00 | 92 | 0.75 | x |
| Comparative Example 2 | 0.50 | 95 | 0.55 | ○ |
| Comparative Example 3 | 0.60 | 95 | 0.50 | Δ |
| Comparative Example 4 | 0.90 | 85 | 0.60 | x |

Note:
○ : Thermal head scum was substantially not generated.
Δ: A little thermal head scum was generated but did not cause problems in practical use.
x: Considerable thermal head scum was generated.

As shown in Table, the heat-sensitive recording materials of the present invention comprising Compounds I and II in combination cause little fogging and generate little thermal head scum while having almost the same sensitivity and image stability as conventional heat-sensitive recording materials.

What is claimed is:

1. A heat-sensitive recording material which comprises a support and a heat-sensitive recording layer provided on the support, the heat-sensitive recording layer comprising a colorless or pale-colored dye precursor, a developer which reacts with the dye precursor to form color upon heating, and two compounds represented by the following formulas (I) and (II):

(I)

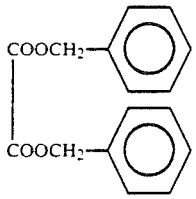

-continued (II)

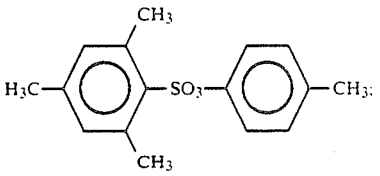

wherein the compounds represented by the formulas (I) and (II) are present respectively in amounts of 25–75% and 5–100% by weight based on the weight of the developer, and total to an amount of 75–175% by weight based on the weight of the developer.

2. A heat-sensitive recording material according to claim 1, wherein the developer is a compound represented by the following formula (III)

(III)

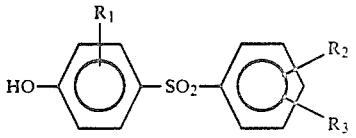

wherein $R_1$ and $R_2$ are independently hydrogen atoms, alkenyl groups, alkyl groups, halogen atoms, or hydroxy groups, and $R_3$ is hydrogen atom, hydroxy group, alkoxy group, or alky group.

* * * * *